US007786880B2

(12) United States Patent
Cole et al.

(10) Patent No.: US 7,786,880 B2
(45) Date of Patent: Aug. 31, 2010

(54) SMOKE DETECTOR

(75) Inventors: Barrett E. Cole, Bloomington, MN (US); James A. Cox, New Brighton, MN (US); Daniel C. Hawkinson, Elburn, IL (US)

(73) Assignee: Honeywell International Inc., Morristown, NJ (US)

( * ) Notice: Subject to any disclaimer, the term of this patent is extended or adjusted under 35 U.S.C. 154(b) by 446 days.

(21) Appl. No.: 11/756,911

(22) Filed: Jun. 1, 2007

(65) Prior Publication Data

US 2008/0297361 A1 Dec. 4, 2008

(51) Int. Cl.
*G08B 17/10* (2006.01)

(52) U.S. Cl. ..... 340/630; 340/511; 340/501; 340/691.1

(58) Field of Classification Search ..... 340/630, 340/628, 627, 603, 501, 506, 511, 517, 521–522, 340/629, 635, 691.1, 693.5, 693.9
See application file for complete search history.

(56) References Cited

U.S. PATENT DOCUMENTS 3,655,288 A * 4/1972 Lieberman et al. ..... 356/315
4,341,471 A * 7/1982 Hogg et al. ..... 356/343
4,728,801 A * 3/1988 O'Connor ..... 250/573
4,870,394 A * 9/1989 Corl et al. ..... 340/630
5,285,213 A * 2/1994 Tusch ..... 343/915
5,373,727 A * 12/1994 Heller et al. ..... 73/38
5,451,931 A * 9/1995 Muller et al. ..... 340/630
5,751,209 A * 5/1998 Werner et al. ..... 340/286.05
5,833,360 A * 11/1998 Knox et al. ..... 362/293
6,665,063 B2 * 12/2003 Jamieson et al. ..... 356/141.1
6,788,197 B1 * 9/2004 Thuillard et al. ..... 340/522
2001/0048907 A1 * 12/2001 Ohmi et al. ..... 422/186.29

OTHER PUBLICATIONS

Weinert, Darryl W., Cleary, Thomas G., Mulholland, George W., Beever, Paula F., Light Scattering Characteristics and Size Distribution of Smoke and Nuisance Aerosols. Fire Safety Science-Proceedings of the Seventh International Symposium, pp. 209-220, published at least before the filing date of the present application.

Edwards, John C., Morrow, Gerald S., Evaluations of Smoke Detectors for Mining Use, Report of Investigations 9586, ISSN 1066-5552, published at least before the filing date of the present application.

* cited by examiner

*Primary Examiner*—Daniel Previl
(74) *Attorney, Agent, or Firm*—Husch Blackwell Sanders Welsh & Katz

(57) ABSTRACT

A smoke detector having a closed internal optical path can detect airborne particulate matter, such as smoke from a fire, via a light scattering sensor and/or a light absorption sensor. The path can be implemented with a plurality of reflectors, such as piezoelectric minors. Input light can be coupled to the path, on a pulsed basis, for example via one of the minors, in a resonant condition.

21 Claims, 2 Drawing Sheets

SMOKE DETECTOR

FIELD

The invention pertains to smoke detectors. More particularly, the invention pertains to such detectors which incorporate a closed optical path, in a housing, and at least one of a sensor of scattered light, or, a sensor of absorbed light:

BACKGROUND

Smoke detectors have become a valuable and useful tool in connection with detecting developing fire conditions. While such detectors are useful for their intended purpose, earlier and earlier fire detection is preferred. Thus, there continues to be a need for smoke detectors which can preferably detect lower and lower levels of smoke to provide for earliest possible detection of developing fires. Preferably such detectors could be integrated into existing alarm systems.

DETAILED DESCRIPTION

Figure 1:
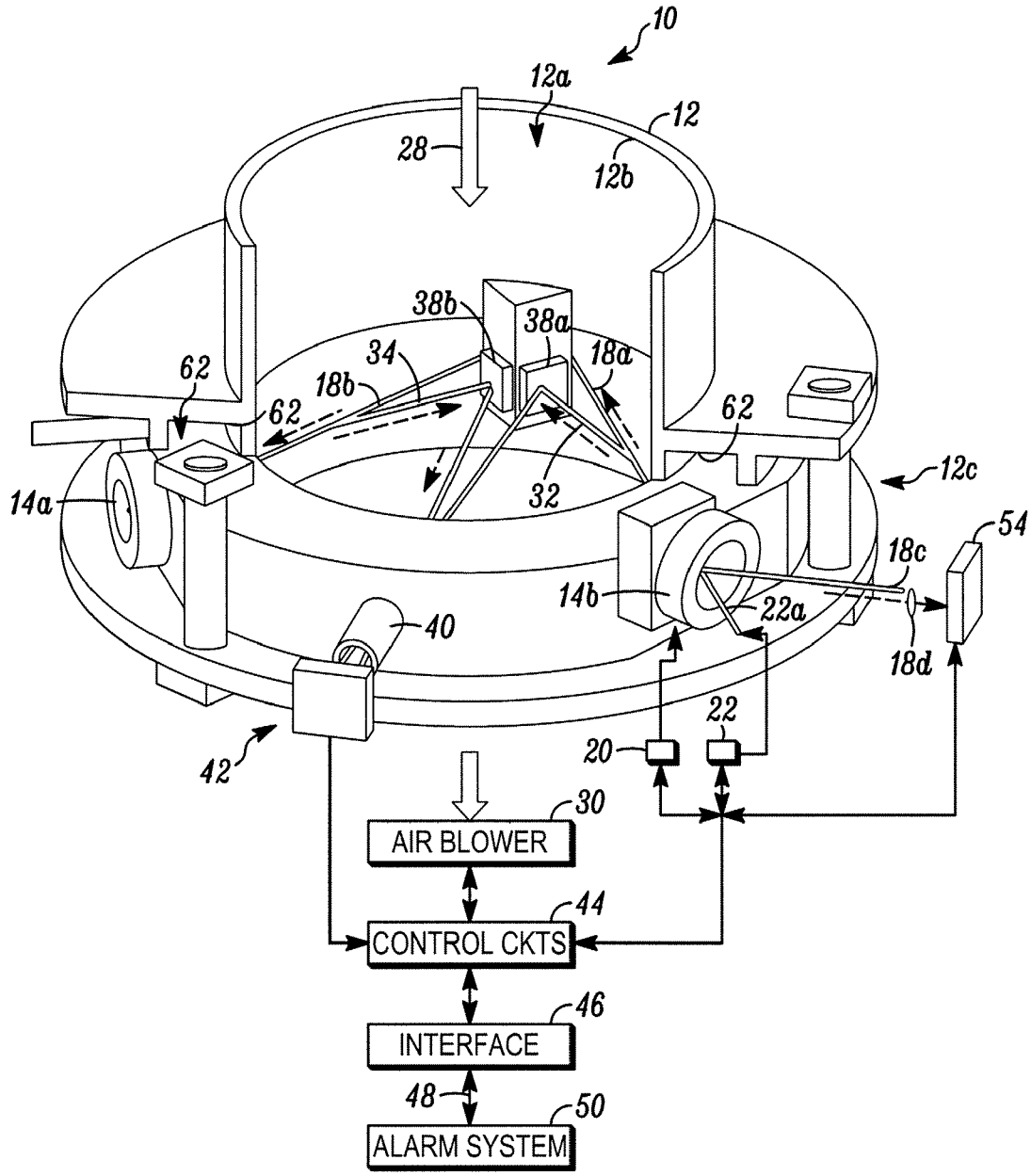
FIG. 1 is a side elevational view partly broken away, of a smoke detector which embodies the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In accordance with one embodiment of the invention, a closed light path is implemented within a hollow housing. A plurality of mirrors can be provided to reflect radiant energy, light, around the path in the housing. In yet another aspect of the invention, the reflectors can be implemented as piezoelectric mirrors.

One of the mirrors can be driven by drive circuitry which couples an electrical signal thereto. A resonant condition can be set up with the cavity, the driven mirror and the light path such that light of a selected wavelength can be coupled through the mirror to the optical path. The light on the path will continue to be reflected about the path with an inherent decay time on the order of micro seconds if the mirror is not constantly driven in a resonant condition to couple additional light into the interior or the cavity.

In yet another aspect of the invention, the subject piezoelectric mirror can be driven continuously or intermittently.

Embodiments of the invention can implement a smoke detector by detecting scattering of light circulating on the optical path due to airborne particulate matter in the cavity. The airborne particulate matter is a telltale component of smoke originated by a fire in the area. Alternately, absorption of the light on the path will be increased due to airborne particulate matter in the chamber. This smoke based absorption characteristic can be sensed and used as an indicator of a fire condition.

In yet another aspect of the invention, the light beam circulating in the internal cavity can become much more intense than the light coupled into the cavity via the resonant condition and one of the piezoelectric mirrors. Smoke detectors which embody the present invention exhibit an amplification effect as light circulating on the internal path cannot readily exit the chamber. As a result, one or more scattering sensors can detect very low amounts of scattering. Further, such low levels of scattering can be detected without interference from background noise which can be very low or diminimus.

In yet another aspect of the invention, each of the reflectors or mirrors can be located behind a cleansing air curtain. The air curtain keeps the surface of the mirror reflector free of airborne particulate matter.

A laser can provide a source of monochromatic light for the light path. In one aspect of the invention, a laser, such as a laser diode, could be associated with each of the chambers. Alternately, one laser can be coupled to a plurality of detectors via optical fibers.

In yet another aspect of the invention, the chamber can exhibit an optical path having a length along the order of 1-20 cm. Such cavities can have a radius on the order of 1 to 3 inches.

Suitable wavelengths for the driving laser, as would be understood by those of skill in the art, can be found in the near infrared or the visible wave lengths. In yet another aspect of the invention the cavity can be tuned. The light source could be implemented as a fixed wavelength laser. In one mode, the selected mirror could be continuously driven without feedback. Representative frequencies could be on the order of one kilohertz. Those of skill in the art will appreciate that decay times of the light on the path can be on the order of microseconds which is very short relative to the mirror driving frequencies.

Figure 2:
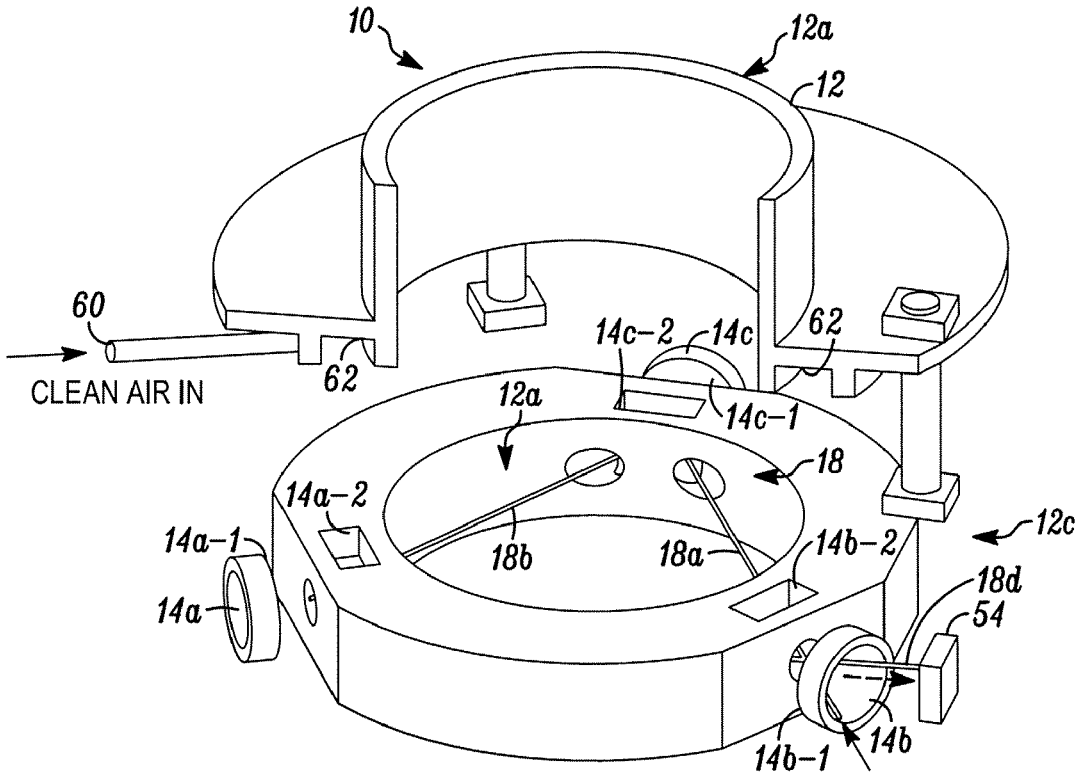
FIG. 2 is an exploded diagram illustrating various details of the detector of FIG. 1.

FIGS. 1 and 2 illustrate different views of a smoke detector 10 which embodies the present invention. The detector 10 includes a housing 12 which defines at least in part, an internal cavity 12*a*. The cavity 12*a* is bounded in part by a cylindrical, peripheral sidewall 12*b*.

A plurality of reflectors 14, which could be implemented as piezoelectric mirrors, has members 14*a*, 14*b* and 14*c* distributed about the internal chamber 12*a* to form a triangularly shaped, closed light path 18. The exemplary light path 18 has three sides in the embodiments of FIGS. 1, 2 namely 18*a*, 18*b* and 18*c*.

One of the piezoelectric mirrors, for example mirror 14*b* can be electrically driven by circuitry 20 as would be understood by those of skill in the art. The circuitry 20, by driving the mirror 14*b* can establish an optical resonant condition such that monochromatic radiant energy 22*a* from a source 22 can be coupled via the respective mirror 14*b* into the cavity 12*a* and onto the light path 18. Source 22 could be implemented for example as a laser diode or any other form of laser without limitation. Driving frequency from circuitry 20 could be on the order of 1-2 kilohertz without limitation.

Light coupled from the source 22 onto the path 18 establishes circulating radiant energy which continuously passes through the cavity 12*a*. Local ambient atmosphere can be coupled into the cavity 12*a* as indicated generally at 28. Ambient atmosphere can be moved through the cavity 12*a* by electrically actuated blower 30.

The ambient atmosphere flowing through cavity 12*a* can carry airborne particulate matter in the form of smoke indicative of a local fire condition. That particulate matter can produce either forward scattered light 32 or back scattered light 34 from the closed path 18.

Forward scattered mirror 38*a* can reflect scattered radiant energy 32 toward a sensor, such as a photo diode 40. Electrical signals from the photo diode 40 can be coupled to a scattered light intensity detector 42. Similarly, a back scatter mirror 38*b* can deflect back scattered light onto the diode 40.

Control circuits 44 can be coupled to the scattered light intensity detector 42 as well as to driving circuitry 20 and source 22 for purposes of controlling the process and for obtaining signals indicative of a smoke or fire condition from sensor 40. Such signals can be coupled via an interface 46 via a wired or wireless medium 48 to a regional alarm system 50.

Alternately, control circuits 44 via a decay or ring down detector 54 can detect light on the path 18 which is absorbed by airborne particulate matter in the ambient atmosphere 28 in the cavity 12*a*. Light on path 18 will be absorbed, and exhibit a decay pattern, by airborne matter from path 18. Detector 54 can respond to an incident exit beam 18*d*, that displays the decay pattern, emitted from cavity 12*a* via mirror 14*b*.

The reflective surfaces 14*a*-1, 14*b*-1, 14*c*-1 of the respective mirrors can be kept clean of airborne particulate matter in chamber 12*a* via a cleaning airflow curtain. The airflow curtain can be implemented with an airflow input port 60 which is coupled to an annular channel 62 which extends about a lower portion 12*c* of the housing 12.

The channel 62 provides a clean air flow path from the inflow port 60 to each of the surfaces 14*a*-1, 14*b*-1 and 14*c*-1 via respective flow ports 14*a*-2, 14*b*-2 and 14*c*-2. Outflow from the ports 14*a*-2, 14*b*-2 and 14*c*-2 washes the respective surfaces 14*a*-1, 14*b*-1 and 14*c*-1 keeping same free from any airborne particulate matter, due to a smoke or fire condition, in the cavity 12*a*.

Those of skill will understand that the size of the cavity 12*a* can be altered consistent with the length of the closed optical path 18, number and position of the mirrors 14 can also be varied all without limitation. Further, various driving frequencies can be coupled to the respective mirror, such as the mirror 14*b*, and various wavelengths can be coupled into the cavity 12*a* from source 22 all without limitation.

In summary, light is stored in the optical cavity 12*a* and can only escape from the path 18 through optical mirror losses in the cavity 12*a* or through absorption or scatter. By operating at wavelengths where there is no gas absorption, the cavity 12*a* can be made sensitive to light scattered via particles in the beam path 18. Because the path length is so long, a small quantity of smoke particles greatly affects the stored intensity. Decay times are usually too fast to permit this type of measurement.

Further, in a triangular cavity, the radiation is polarized. This effect can be used to observe and used to discriminate between (fire and non-fire) particles that scatter differently in polarized light. It is also possible to operate at a number of different wavelengths to get a sense of the particle size distribution since scatter varies as 1^4.

Additionally, a scatter detector can be placed at spot in the cavity 12*a* where ambient air is swept through. The high stored power in the cavity can be used, to provide an angle scatter signal for the scattered light. In this mode, the optical cavity is used to enhance the radiation level.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A detector of airborne particulate matter comprising:

a hollow housing;

a plurality of reflectors, located within the hollow housing, providing a closed optical path in the hollow housing so that radiant energy in the closed optical path is reflected directly between each of the plurality of reflectors;

a source to inject radiant energy into the closed optical path, the radiant energy is continuously reflected about the closed optical path in the hollow housing; and at least one of a scatter sensor of radiant energy to detect scattered radiant energy from the closed optical path caused by airborne particulate matter in the hollow housing, or a decay sensor of an absorption characteristic of radiant energy emitted from the closed optical path.

2. A detector as in claim 1 where the reflectors comprise a plurality of dielectric mirrors.

3. A detector as in claim 1 where the scatter sensor includes at least one of a forward scatter mirror, and a back scatter mirror, and, a scattered light sensing element.

4. A detector as in claim 1 which includes a drive circuit coupled to one of the mirrors the driven mirror emitting light from an exterior source into the cavity and onto the optical path.

5. A detector as in claim 4 where the decay sensor receives radiant energy from the path, via one of the mirrors.

6. A detector as in claim 5 which includes at least one of a scattered signal evaluation circuit, coupled to the scatter sensor, or a decay characteristic signal evaluation circuit coupled to the decay sensor.

7. A detector as in claim 6 where the scattered signal evaluation circuit compares a signal from the scatter sensor to a pre-determined threshold indicative of a level of smoke in the chamber.

8. A detector as in claim 5 which includes a cleaning gas input port that couples an inflow of cleaning gas to at least some of the reflectors.

9. A detector as in claim 8 where the gas inflow port is coupled to an annular channel around the housing, the channel having a plurality of cleaning gas outflow ports, each port is adjacent to a respective reflector.

10. A detector as in claim 1 which includes a cleaning gas input port that couples an inflow of cleaning gas to at least some of the reflectors.

11. A detector as in claim 10 where the gas inflow port is coupled to an annular channel around the housing, the channel having a plurality of cleaning gas outflow ports, each port is adjacent to a respective reflector.

12. A detector as in claim 11 where each reflector has an optical path surface, in the optical path, and in a gas flow path which is coupled to the cleaning gas inflow port.

13. A detector as in claim 1 where the source comprises a source of mono-chromatic light.

14. A method comprising:

establishing a region, bounded in part;

establishing a closed optical path in the region between a plurality of reflectors in the region so that light in the closed optical path is reflected directly between each of the plurality of reflectors;

injecting mono-chromatic light into the closed optical path to continuously circulate therealong in the region; and sensing light scattered from the closed optical path in response to particulate matter in the region.

15. A method as in claim 14 which includes reflecting the light at a plurality of spaced apart locations on the optical path.

16. A method as in claim 15 which includes injecting a gas into the region at each of the plurality of spaced apart locations to displace particulate matter in the region from each such location.

17. A method as in claim 16 which includes positioning a dielectric mirror at each of the locations and coupling a driving signal to one of the mirrors.

18. A method as in claim 14 which includes sensing a decay characteristic of light on the path.

19. A method as in claim 14 where injecting includes intermittently injecting light into the path.

20. A method as in claim 14 which includes injecting ambient atmosphere into the region.

21. A smoke detector comprising:

a housing which defines, at least in part, an internal region;

a plurality of mirrors disposed in the internal region, the mirrors at least in part, define a continuous optical path in the region between the mirrors so that light in the continuous optical path is reflected directly between each of the plurality of mirrors;

a source of mono-chromatic light, the light being couplable to the continuous optical path and continuously circulating on the continuous optical path in the region;

a gas distribution channel, carried by the housing outside of the region, the gas distribution channel defining an inflow port and a plurality of outflow ports with one outflow port adjacent to each of the mirrors; and a sensor of gas born smoke related particulate matter in the region, the sensor emitting an electrical signal indicative of smoke related particulate matter in the region.

* * * * *